US007544154B2

(12) United States Patent
Corbalis et al.

(10) Patent No.: US 7,544,154 B2
(45) Date of Patent: Jun. 9, 2009

(54) CHAIN GUARD ARRANGEMENT FOR SPINNING BIKES

(75) Inventors: Kevin P. Corbalis, Tustin, CA (US); Raymond Lim, Stanton, CA (US); Victor Torres Cornejo, Tustin, CA (US)

(73) Assignee: Unisen, Inc., Irvine, CA (US)

( * ) Notice: Subject to any disclaimer, the term of this patent is extended or adjusted under 35 U.S.C. 154(b) by 716 days.

(21) Appl. No.: 10/882,652

(22) Filed: Jul. 1, 2004

(65) Prior Publication Data

US 2006/0003870 A1 Jan. 5, 2006

(51) Int. Cl.
*A63B 22/06* (2006.01)

(52) U.S. Cl. ..... 482/57; 474/144

(58) Field of Classification Search ..... 482/51, 482/57, 64, 65; D12/127; 474/144, 140; 280/304.3

See application file for complete search history.

(56) References Cited

U.S. PATENT DOCUMENTS

| | | | | | |
|---|---|---|---|---|---|
| 1,400,131 | A | * | 12/1921 | Adams | 474/144 |
| 1,636,327 | A | * | 7/1927 | Roe | 474/144 |
| 4,054,063 | A | * | 10/1977 | Perrin | 474/147 |
| RE30,547 | E | * | 3/1981 | Belden | 280/240 |
| 4,846,156 | A | * | 7/1989 | Kopnicky | 601/36 |
| 4,908,008 | A | * | 3/1990 | Gorski | 474/146 |
| D376,569 | S | * | 12/1996 | Fang | D12/127 |
| 5,961,424 | A | | 10/1999 | Warner et al. | |
| 6,533,690 | B2 | | 3/2003 | Barnett | |
| 6,669,603 | B1 | | 12/2003 | Forcillo | |
| 6,793,608 | B2 | * | 9/2004 | Goldberg et al. | 482/57 |
| 6,951,344 | B2 | * | 10/2005 | De Oliveira | 280/281.1 |
| 7,066,856 | B1 | * | 6/2006 | Rogers | 474/144 |
| 7,226,393 | B2 | * | 6/2007 | Baker | 482/57 |
| 2002/0137601 | A1 | * | 9/2002 | Tobias et al. | 482/52 |

FOREIGN PATENT DOCUMENTS

| | | |
|---|---|---|
| DE | 297 17 853 U1 | 8/1998 |
| DK | 95 00176 U3 | 7/1995 |

* cited by examiner

*Primary Examiner*—Loan H Thanh
*Assistant Examiner*—Tam Nguyen
(74) *Attorney, Agent, or Firm*—Knobbe, Martens, Olson & Bear, LLP

(57) ABSTRACT

A guard assembly for exercise bikes has a master sprocket guard and a slave sprocket guard that are separate from each other and that are positioned between a master sprocket and a slave sprocket. A flexible transmitter such as a belt or chain extends through a portion of the master sprocket guard and the slave sprocket guard but does not make more than incidental contact with the guards.

28 Claims, 6 Drawing Sheets

CHAIN GUARD ARRANGEMENT FOR SPINNING BIKES

BACKGROUND OF THE INVENTION

1. Field of the Invention

The present invention generally relates to a chain guard arrangement for spinning bikes. More particularly, the present invention relates to a chain guard arrangement disposed at an entrance to one or more sprockets of a spinning bike.

2. Description of the Related Art

Exercise bicycles generally comprise a flywheel that is driven by pedals. In some arrangements, the pedals are connected to the flywheel with a chain drive arrangement. In such arrangements, the pedals drive a master sprocket, which turns a slave sprocket through a chain. The slave sprocket is coupled to the flywheel.

The chain drive is generally enclosed within a housing, which can include a primary cover. The housing and the primary cover protect operators of the exercise bicycles from the moving components contained within the housing. The primary cover, however, often is removed by the owner of the exercise bicycle for access to the chain drive. Such access may be desired to perform routine maintenance operations. For instance, the chain drive may require an increase in chain tension over time as the chain stretches. Moreover, the chain drive often benefits from periodic lubrication.

SUMMARY OF THE INVENTION

While operators of the exercise equipment are protected by the primary cover during exercise, the moving parts may be exposed during maintenance. While warnings are issued and proper maintenance techniques are advised, the chain drive can become damaged (e.g., foreign objects can jam between the sprocket and the chain) during maintenance operations. Thus, a structure is desired that can limit the size of foreign objects that may be drawn between the chain and the sprocket when the primary cover is removed for maintenance.

One aspect of the present invention involves an exercise bicycle comprising a frame. A seat is adjustably attached to the frame. A handlebar is attached to the frame. The frame comprises a front fork assembly. A flywheel extends through the front fork assembly. A slave sprocket is connected to the flywheel. The slave sprocket rotates about a slave sprocket axis. A pedal is attached to a crank arm. A crank arm is attached to a master sprocket. The master sprocket is supported by the frame and rotates about a master sprocket axis. A flexible transmitter connects the master sprocket and the slave sprocket. An inner guard is positioned between the master sprocket. An outer guard is connected to the inner guard and a chamber is defined between the inner guard and the outer guard. A master sprocket guard and a slave sprocket guard are spaced from each other while being positioned within the chamber. They also are positioned between the master sprocket axis and the slave sprocket axis.

Another aspect of the present invention involves an exercise bicycle comprising a frame. The frame comprises a first crossing member that is adapted to be positioned in a fixed location on a support surface. A seat is adjustably attached to the frame and a handlebar is attached to the frame. A flywheel is rotatably supported on the frame. A resistance assembly is mounted to the frame. The resistance assembly comprises an adjustment knob. The adjustment knob is adapted to allow adjustment of a level of resistance to rotation of the flywheel. A slave sprocket is drivingly coupled to the flywheel. A pedal is connected to a master sprocket. The master sprocket is supported by the frame. A flexible transmitter connects the master sprocket and the slave sprocket. An inner guard is connected to the frame. The inner guard comprises a body that is interposed between a portion of the master sprocket and the frame. The body comprises an opening that is positioned in the body at a location proximate the flywheel. An outer guard is supported by the frame and comprises a first opening and a second opening. The first opening is positioned proximate the master sprocket and the second opening has at least a portion that is generally aligned with the opening through the body of the inner guard. A master sprocket guard is positioned between the inner guard and the outer guard. A slave sprocket guard is positioned between the inner guard and the outer guard. At least a portion of the second opening of the outer guard is positioned between the master sprocket guard and the slave sprocket guard.

A further aspect of the present invention involves an exercise bicycle comprising a frame. A seat is supported by the frame. A handlebar is supported by the frame. A master sprocket is supported by the frame. A slave sprocket is supported by the frame. A flexible transmitter connects the master sprocket and the slave sprocket. An outer guard overlays the master sprocket and the slave sprocket. A master sprocket guard extends only partway around the master sprocket. The master sprocket guard is positioned between the master sprocket and the slave sprocket. The master sprocket guard defines a first passageway and a second passageway. The flexible transmitter extends through the first passageway and the second passageway.

An aspect of the present invention also involves an exercise bicycle comprising a frame. A seat is adjustably attached to the frame. A handlebar is attached to the frame. The frame comprises a front fork assembly. A flywheel extends through the front fork assembly. A slave sprocket is connected to the flywheel. The slave sprocket rotates about a slave sprocket axis. A first imaginary transverse generally vertical plane extends through the slave sprocket axis. A pedal is connected to a master sprocket. The master sprocket is supported by the frame and rotates about a master sprocket axis. A second imaginary transverse generally vertical plane extends through the master sprocket axis. A flexible transmitter connects the master sprocket and the slave sprocket. A master sprocket guard and a slave sprocket guard are spaced from each other and do not extend beyond a space bounded by the first imaginary traverse generally vertical plane and the second imaginary traverse generally vertical plane.

An additional aspect of the present invention involves an exercise bicycle that comprises a frame, a seat supported by the frame, and a handlebar supported by the frame. A master sprocket is supported by the frame and a slave sprocket is supported by the frame. A flexible transmitter connects the master sprocket and the slave sprocket. An outer guard overlays the master sprocket and the slave sprocket. A master sprocket guard extends only partway around the master sprocket. The master sprocket guard is positioned between the master sprocket and the slave sprocket. The master sprocket guard defines a passageway. The flexible transmitter extends through the passageway and does not contact the passageway.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENT

Figure 1:
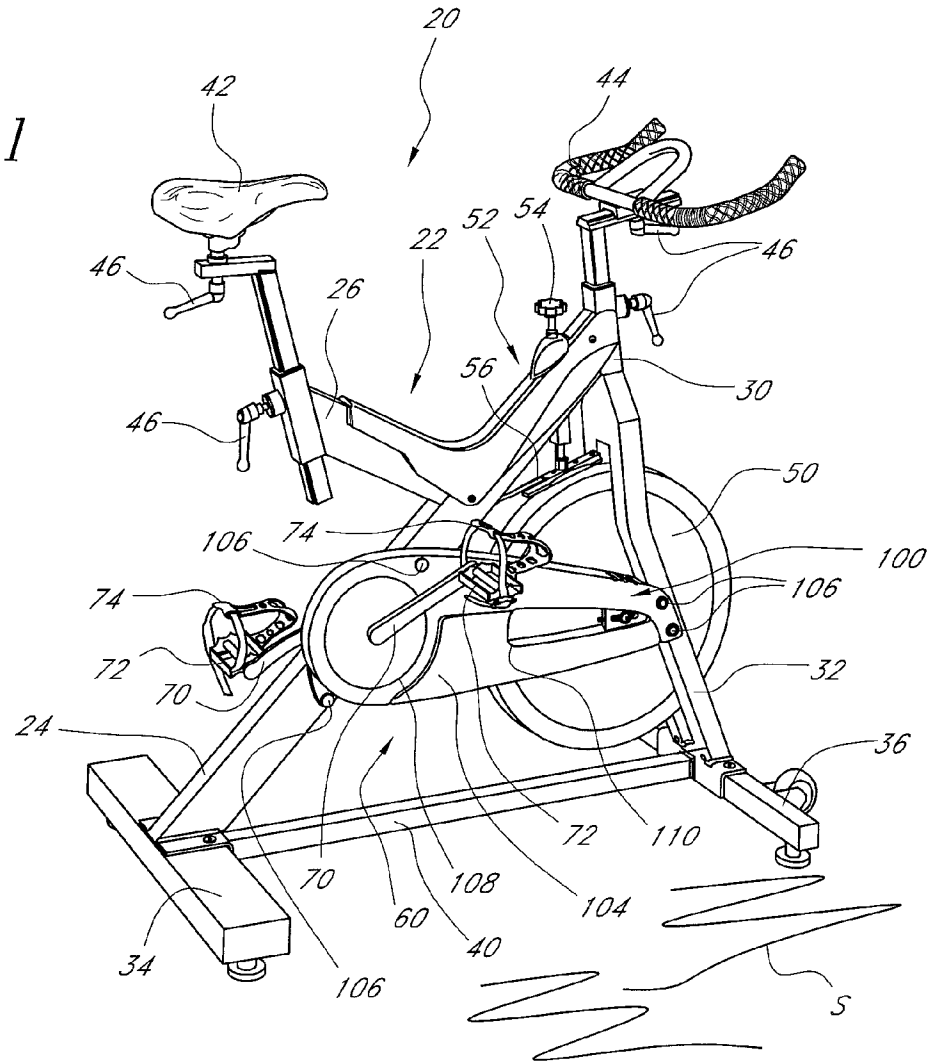
FIG. 1 is a perspective view of an exercise bicycle that is arranged and configured in accordance with certain features, aspects and advantages of the present invention.

An exercise bicycle 20 that is arranged and configured in accordance with certain features, aspects and advantages of the present invention is shown in FIG. 1. The illustrated arrangement features a type of exercise bicycle commonly known as a "spin bike." A spin bike is a form of stationary bicycle that commonly is used in an exercise program known as spinning. Spinning involves a series of cycling movements that provide the participant with both a physical and mental workout. The spinning bike is designed to mimic an outdoor bicycle ride. As will be described, the spinning bike typically has fixed gear-racing handlebars, pedals equipped with clips or cages, and an adjustable bike seat. The intensity of the workout can be adjusted by manipulating a resistance knob, which is located on each spinning bicycle. It should be appreciated that other arrangements of the present invention can be used on other forms of stationary exercise equipment that utilize a chain drive.

The illustrated bicycle 20 generally comprises a frame 22. The illustrated frame comprises a primary down tube 24, which extends at an angle relative to a support surface S on which the bicycle 20 rests. A rear tube 26 extends upward at an angle from a middle portion of the down tube 24. A forward tube 30 extends downward from a forward portion of the down tube 24. A fork assembly 32 is connected to a lower portion of the forward tube 30. In some arrangements, the fork assembly 32 can extend from the down tube 24.

A first crossing member 34 is connected to a lower rearward portion of the frame 22 and a second crossing member 36 is connected to a lower forward portion of the frame 22. The crossing members 34, 36 can be connected to the balance of the frame 22 in any suitable manner and are welded thereto in the illustrated arrangement. The crossing members 34, 36 provide lateral support to the frame 22 but any other suitable support construction also can be used. In the illustrated arrangement, a longitudinal connecting member 40 also is shown. The connecting member 40 extends between the two crossing members 34, 36 and is connected thereto in any suitable manner.

A seat 42 and a set of handlebars 44 are adjustably connected to the frame 22. Any suitable mechanisms allowing for adjustment of the seat 42 and/or the handlebars 44 can be used. In the illustrated arrangement, levers 46 are provided that can be used to tighten the seat 42 and/or the handlebars 44 in position. Moreover, the illustrated seat 42 can be adjusted fore and aft and up and down. Similarly, the illustrated handlebars 44 can be adjusted fore and aft and up and down.

With continued reference to FIG. 1, a flywheel 50 is positioned below the down tube 24. In the illustrated arrangement, the flywheel 50 is mounted between the legs of the fork assembly 32. Any suitable mounting configuration can be used. The flywheel 50 provides a rotating mass that allows the cyclist to experience some degree of rotational inertia.

A resistance assembly 52 is provided to adjust the level of resistance to rotation of the flywheel 50. The resistance assembly 52 acts to slow or stop rotation of the mass of the flywheel 50 such that the sense of inertia can be adjusted. Any suitable resistance assembly 52 can be used. In the illustrated arrangement, an adjusting knob 54 is operably connected to a friction member 56 such that rotation of the knob 54 can increase or decrease the level of friction applied by the friction member 56 to the flywheel 50.

Figure 2:
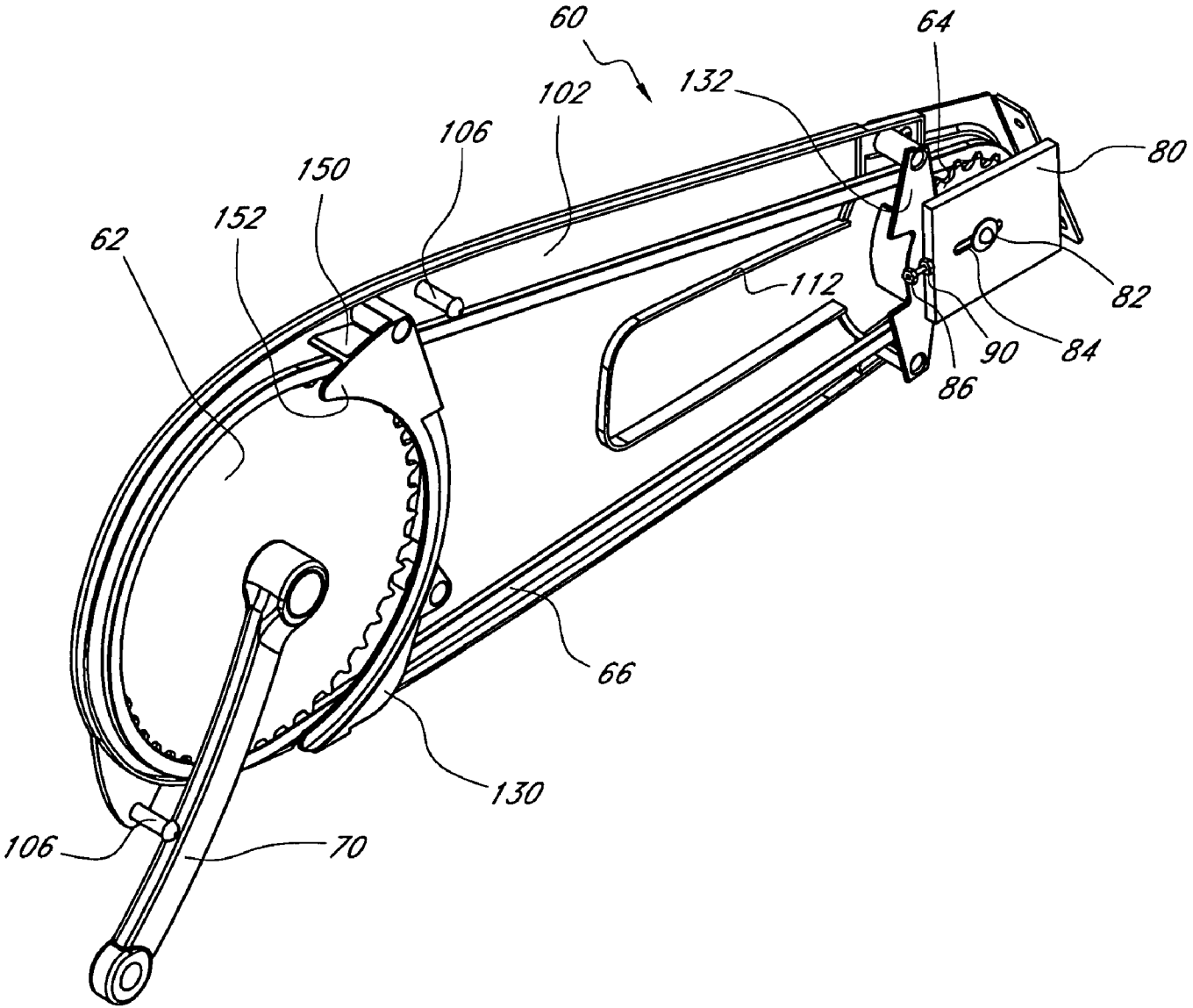
FIG. 2 is a perspective view of a portion of a gear train and guard assembly used on the bicycle of FIG. 1.

A gear train 60 is provided to drive the flywheel 50. The gear train 60 is attached to the frame 22 in any suitable manner. With reference to FIG. 2, in the illustrated arrangement, the gear train 60 comprises a master sprocket 62, a slave sprocket 64 and a flexible transmitter 66, such as a chain or drive belt. The flexible transmitter is formed in a loop about the master sprocket 62 and the slave sprocket 64 such that driving movement of the master sprocket 62 causes driven movement of the slave sprocket 64. The slave sprocket 64 is connected to the flywheel 50 such that movement of the slave sprocket 64 causes rotational movement of the flywheel 50. In some arrangements, a clutching configuration can be used to allow the flywheel 50 to continue rotation while at least one component of the drive train 60 remains stationary (e.g., the master sprocket 62, the slave sprocket 64, etc.) Moreover, because the illustrated arrangement is a spin bicycle, only one master sprocket 62 and only one slave sprocket 64 are shown. Other arrangements are possible.

A pair of crank arms 70 is provided and a pedal 72 is mounted to each of the pair of crank arms 70. As shown in FIG. 1, each of the pedals 72 preferably includes a clip, cage 74 or the like that accommodates a foot of the user of the bicycle 20. The crank arms 70 are secured to the master sprocket 62 in any suitable manner.

With reference again to FIG. 2, the slave sprocket 64 is adjustable relative to the master sprocket 62. As such, the level of tension in the flexible transmitter 66 can be adjusted. In the illustrated arrangement, the slave sprocket 64 is mounted relative to a support bracket 80. A shaft, not shown, for the slave sprocket is secured in position with a shaft fastener 82 that extends through a slot 84 formed in the bracket 80. The shaft fastener 82 can be a bolt, threaded fastener or a sleeve that is internally threaded or any other construction suitable to maintain the slave sprocket in position adjacent to the bracket 80.

The slot 84 in the bracket 80 allows the slave sprocket 64 to move generally toward and away from the master sprocket 62. A tensioning fastener 86 has an axial direction that generally corresponding with the direction in which the slot 84 extends. The tensioning fastener 86 is mounted such that rotation of the fastener 86 causes radial movement of the slave sprocket 64. In the illustrated arrangement, the tensioning fastener 86 extends through a threaded sleeve or nut, not shown, that is secured in position on the bracket 80. An end of the tensioning fastener 86 abuts a shaft attached to the slave sprocket or abuts a portion of the fastener 82. Once the appropriate tension has been applied to the flexible transmitter 66, a locking nut 90 can be used to secure the relative rotational position of the tensioning fastener, and hence the relative spacing between the master sprocket 62 and the slave sprocket 64.

The gear train 60 is positioned within a chamber defined by an enclosure 100. The enclosure comprises an outer guard 104 and an inner guard 102. The inner and outer guards 102, 104 generally define a cavity within which the flexible transmitter operates. The inner and outer guard 102, 104 can be secured together in any suitable manner. Preferably, the inner guard 102 and the outer guard 104 are secured together in a manner that decreases the likelihood that the one of the guards can be removed without the purposeful use of a hand tool or the like. Such an arrangement decreases the likelihood of unauthorized removal of the guards 102, 104. In one configuration, at least one threaded fastener is used. In other configurations, more than one threaded fastener is used. In the illustrated embodiment, four threaded fasteners 106 are used to secure the outer guard 104 to the inner guard 102. More preferably, these fasteners 106 secure the outer guard 104 over the inner guard 102 to the frame 22. Even more preferably, one or more fasteners can separately secure the inner guard 102 to the frame 22.

With reference to FIG. 1, the outer guard 104 generally comprises an enlarged opening 108 that is positioned proximate the master sprocket 62. The enlarged opening 108 accommodates the crank arm 70 and provides a pleasing aesthetic appearance to the guard. Furthermore, the opening 108 exposes a portion of the illustrated master sprocket 62. A second opening 110 exposes a portion of the flywheel 50. Preferably, the flexible transmitter 66 substantially circumscribes the opening 110.

Figure 5:
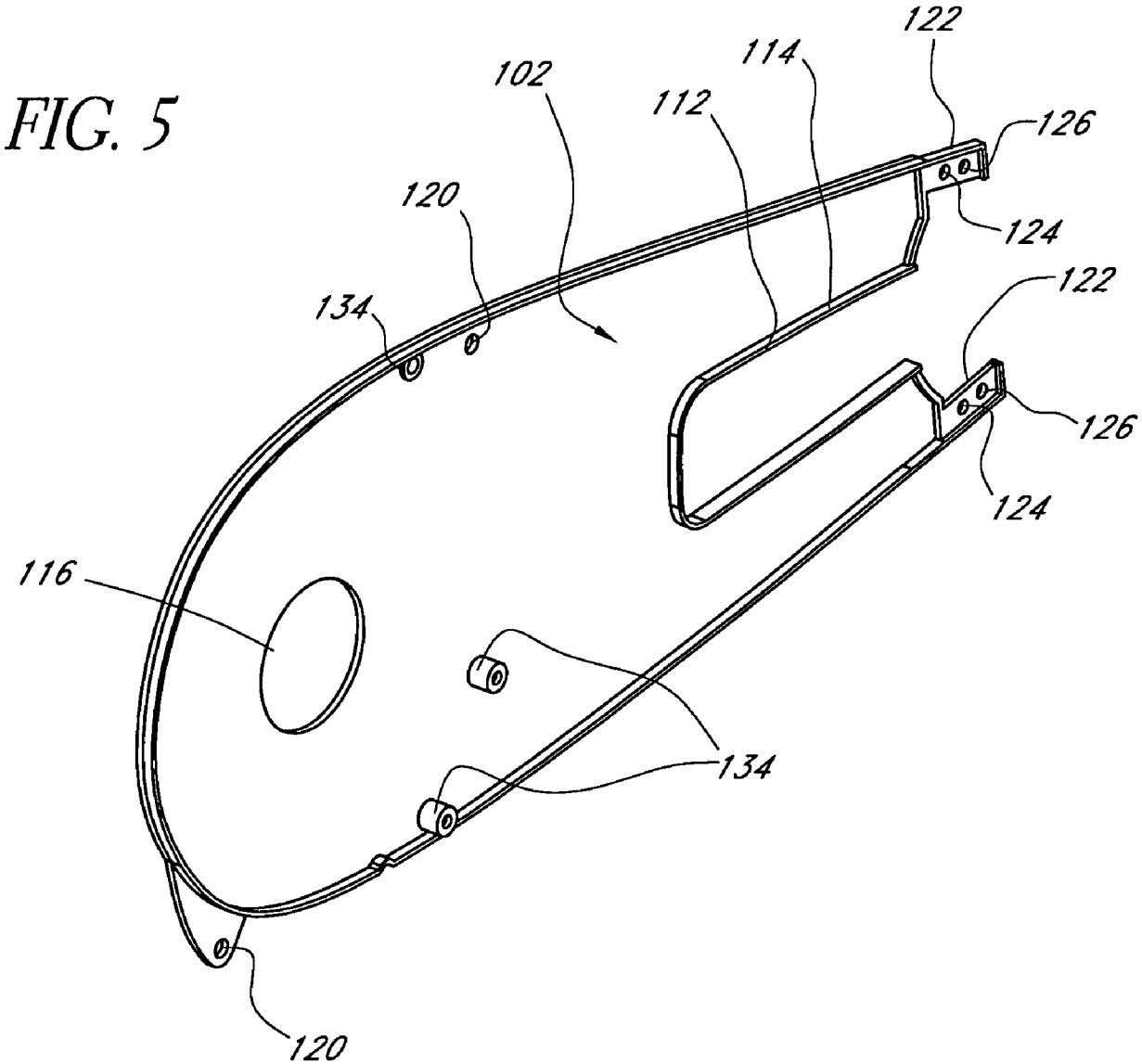
FIG. 5 is a perspective view of an inner guard of the guard assembly of FIG. 2.

With reference again to FIG. 2, the inner guard 102 also comprises an opening 112. In order for the flywheel 50 to be visible through the second opening 110 of the outer guard 104, the opening 112 of the inner guard extends over a portion of the flywheel 50 and the second opening 110 of the outer guard overlaps with the opening 112 of the inner guard 102 such that the flywheel 50 can be viewed through both guards 102, 104. In the illustrated arrangement, a lip 114 (see FIG. 5) extends proximate the opening 112. The lip 114 in the illustrated arrangement extends around a periphery of the guard 102. The lip 114 stiffens the guard 102 and, in the illustrated arrangement, defines a shallow tray-like structure.

The inner guard 102 also comprises a small crank arm opening 116. In the illustrated arrangement, the crank arm opening 116 is generally aligned with an axis about which the crank arm 70 rotates. Because the illustrated inner guard 102 will generally abut against a portion of the frame 22 in the illustrated arrangement, the crank arm opening 116 preferably has a diameter small enough to be concealed by the down tube 24 when mounted to the down tube 24.

In the illustrated arrangement, the inner guard 102 comprises outer guard mounting apertures 120. One of the outer guard mounting apertures 120 is positioned on a flange 122 while the other mounting aperture 120 is positioned within the body of the guard 102. Moreover, a pair of mounting flanges 122 extends outward from an end of the illustrated guard 102. The flanges 122 each contain a first hole 124 and a second hole 126. One of the holes 124, 126 is used to secure the inner guard 102 to the frame 22 or another suitable component and the other of the holes 124, 126 is in a manner that will be described.

Advantageously, the inner guard 102 provides locations to which a master sprocket guard 130 and a slave sprocket guard 132 can be mounted. In the illustrated arrangement, at least one mounting boss 134 extends away from the body of the inner guard 102. In particular, three mounting bosses 134 extend. Two of the mounting bosses 134 can be sized and shaped to receive threaded inserts while the third of the mounting bosses 134 can provide a through opening such that a threaded fastener can extend through the inner guard 102 and into the frame 22. As illustrated in FIG. 2, the mounting bosses 134 preferably support the master sprocket guard 130 while one of the holes 124, 126 of each of the flanges supports the slave sprocket guard 132. Other suitable arrangements can be used. For instance, mounting bosses can be provided for both the master and slave sprocket guards 130, 132. In other arrangements, the guards 130, 132 can be supported by the frame 22 rather than the bosses 134.

Figure 4:
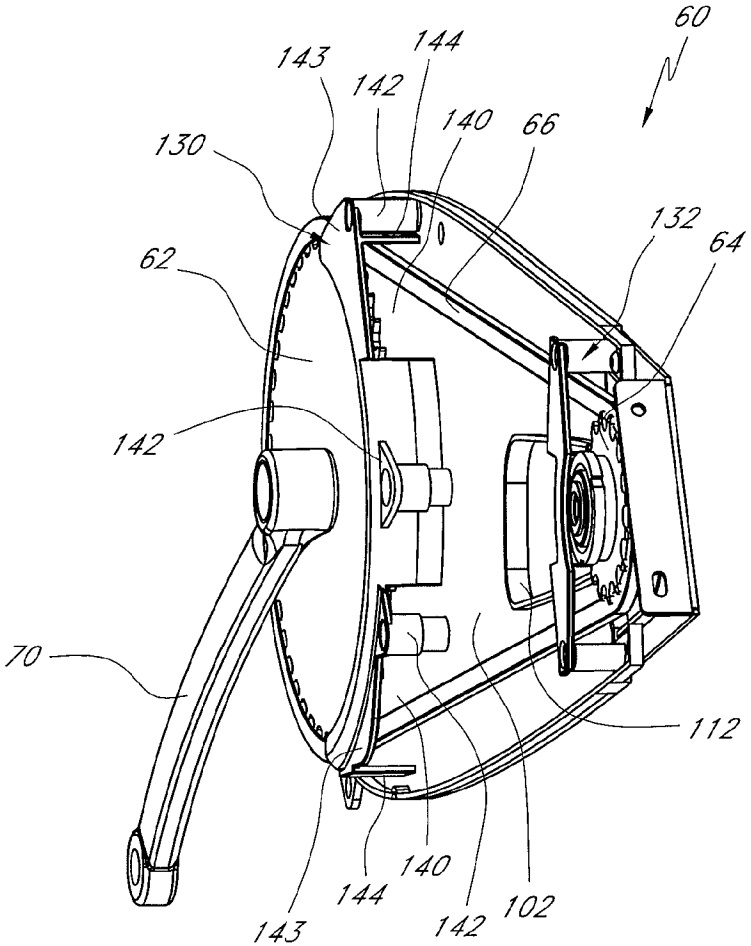
FIG. 4 is a front perspective view of the gear train and guard assembly of FIG. 2.
Figure 6:
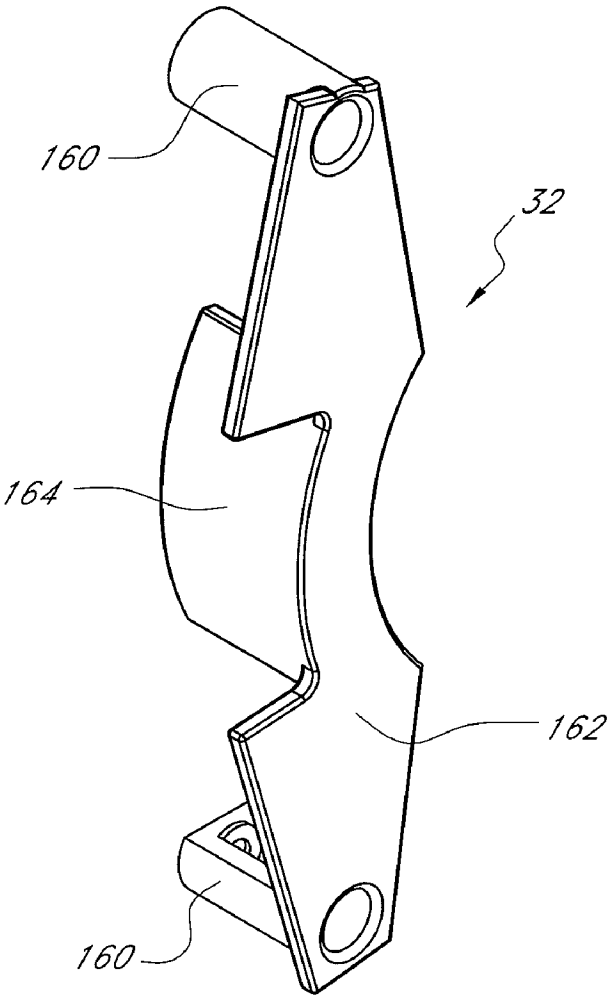
FIG. 6 is a perspective view of a slave sprocket guard of the guard assembly of FIG. 2.

With reference now to FIG. 6, the illustrated master sprocket guard 130 comprises a single piece construction that extends over the tangential meshing region of the flexible transmitter 66 with the master sprocket 62. Preferably, the guard 130 extends over both the top and bottom meshing regions. As illustrated in FIG. 4, the guard 130 comprises two passageways 140 that each are defined between a pair of posts 142. In the illustrated arrangement, a flange 144 extends into the pass through portions to limit the size of the opening defined between the posts. The posts 142 preferably accommodate a threaded fastener 146 and the posts 142 preferably are aligned with the mounting bosses 134. In the illustrated arrangement, the posts 142 are formed in extensions 143 but other constructions are possible.

The flange 144 preferably is spaced from one of the posts a sufficient distance to reduce the likelihood that an under-tensioned chain will impinge upon either the flange 144 or the post 142. In the illustrated arrangement, the flanges 144 are positioned between the regions through which the flexible transmitter passes. In some arrangements, a single flange can be used. In other arrangements, the posts can be positioned to limit the size of opening through which the chain passes. The opening preferably is greater than about ¼ inch but less than 2 inches. In a preferred arrangement, the opening is greater than about ¼ inch but less than about 1 and ½ inches. In a more preferred arrangement, the opening is less than about 1 inch.

With reference to FIG. 2, the guard 130 also comprises a shield 150 that extends along the flexible transmitter 66 and is positioned atop the upper meshing region. Preferably, the shield extends slightly forward of the meshing region. In some arrangements, a similar shield can be positioned adjacent the lower meshing region.

With continued reference to FIG. 2, the guard 130 also comprises an arcuate embossed portion 152. The embossed portion 152 advantageously corresponds to an outer diameter of the master sprocket 62 and decreases the overall profile of the guard 130. In the illustrated arrangement, the guard 130 extends over less than about 180 degrees of the master sprocket 62. In some arrangements, the guard 130 extends over about 160 degrees of the master sprocket. In most preferred arrangements, the guard 130 extends over less than 180 degrees but more than the portion of the sprocket not engaged by the chain (i.e., the portion of the sprocket with exposed cogs).

Figure 3:
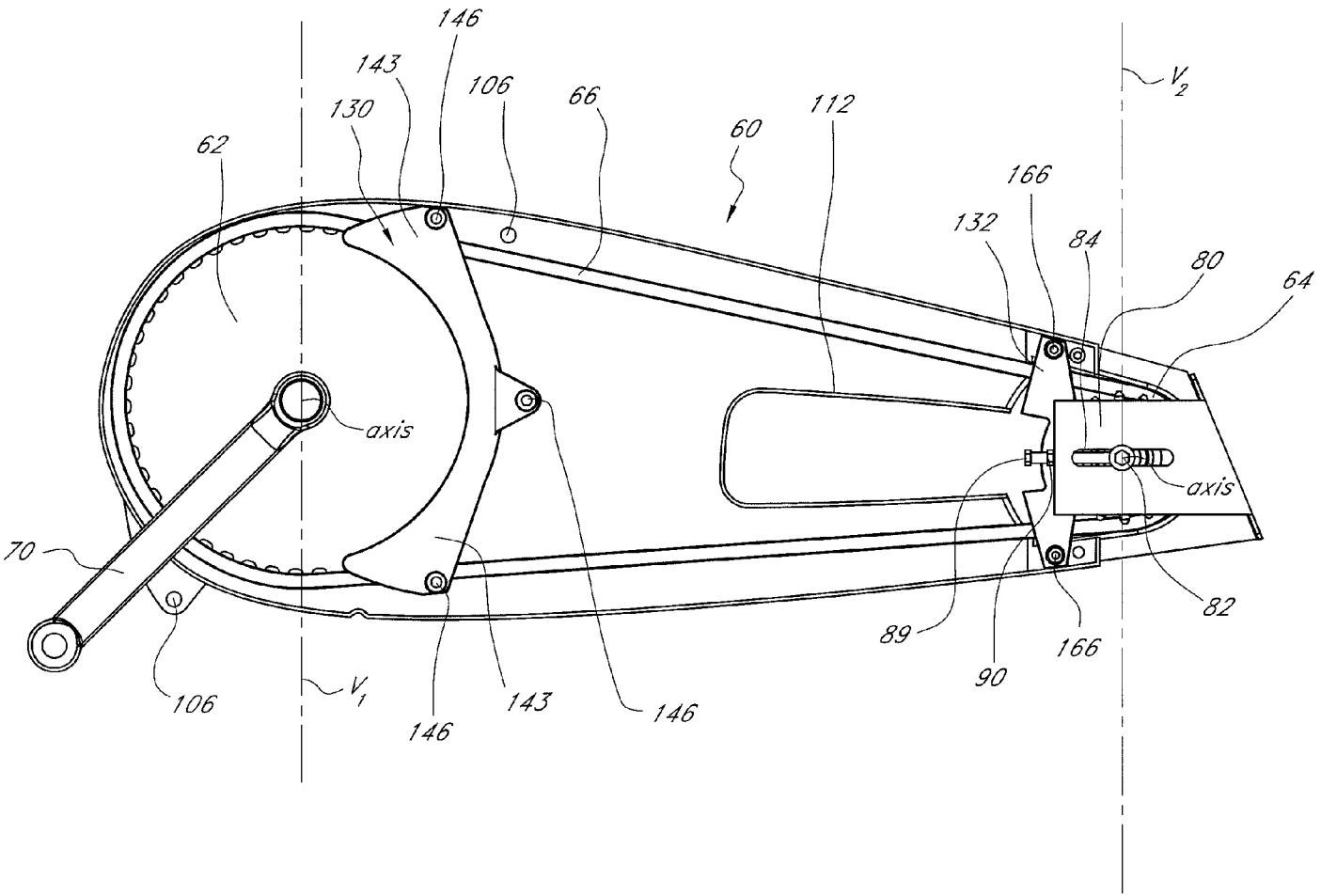
FIG. 3 is a side elevation view of the gear train and guard assembly of FIG. 2.

With reference to FIGS. 2, 3 and 6, the slave sprocket guard 132 is positioned generally between the master and slave sprockets 62, 64 and generally adjacent to the slave sprocket 64. In the illustrated arrangement, the slave sprocket guard 132 does not overlie the meshing region between the slave sprocket and the flexible transmitter. The slave sprocket guard 132, instead, is positioned generally rearward of such a location because of the smaller diameter of the slave sprocket 64. In some arrangements, however, the guard 132 could be positioned generally at the meshing region.

The slave sprocket guard 132 preferably comprises two posts 160, a main body 162 and a flange 164 that is positioned generally between the posts 160. As discussed above, the posts 160 preferably are generally aligned with the openings 124 in the flanges 122 of the inner guard 102. The posts 160 accommodate fasteners 166 and the fasteners secure the guard 132 in position relative to the frame 22.

The flange 164 extends in the same direction of the main body 162 as the posts 160 in the illustrated arrangement. The flange extends over a majority of the cogs that are not engaged with the chain at any given moment. Thus, the guard 132 defines a pair of passages between the posts 160 and the edges of the flange 164. The passages preferably are more than two thicknesses of the flexible transmitter across such that the flexible transmitter can pass through the passages without substantial interference. The passages, however, preferably are less than four, and more preferably less than three, thicknesses of the flexible transmitter across.

In the illustrated arrangement, once the outer guard 104 is removed, such as during maintenance, for example, the bicycle 20 still provides a master sprocket guard 130 and a slave sprocket guard 132 that are positioned generally between the master sprocket 62 and the slave sprocket 64. In one arrangement, the openings 110, 112 are at least partially positioned between the guards 130, 132. In some arrangements, the guards 130, 132 are positioned between a rotational axis of the master sprocket 62 and a rotational axis of the slave sprocket 64. Even more particularly, one preferred arrangement features guards 130, 132 that do not extend out of a region bounded by a pair of transverse generally vertical planes that extend through the rotational axes of the master and slave sprockets. Such placement can reduce the likelihood of items coming between the flexible transmitter and sprocket, which otherwise might cause the chain to jam or being disengaged from the sprocket. The flexible transmitter 66 passes through both guards 130, 132 and, more preferably, passes twice through each of the guards 130, 132. The guards 130, 132 preferably define passages through which the flexible transmitter 66 passes before wrapping onto the sprockets 60, 62. Even more preferably, the flexible transmitter 66 does not contact either of the guards 130, 132 although it passes through the passages. The illustrated construction also provides guards 130, 132 that do not completely encircle the sprockets 60, 62 and can be easily removed during maintenance by removing three or less fasteners each, if necessary or desired.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. In some arrangements, the master and/or slave sprocket guards can be integrally formed with the inner guard and the passageways defined, in part, by insertable posts, pegs, cylinders or the like. In other arrangements, the master and/or slave sprocket guards can be broken into separate components such that an upper and a lower master and/or slave sprocket guard is provided. For instance, the master sprocket guard could be formed in two pieces with one defining an upper passageway and another defining a lower passageway. Moreover, not all of the features, aspects and advantages are necessarily required to practice the present invention. Accordingly, the scope of the present invention is intended to be defined only by the claims that follow.

What is claimed is:

1. An exercise bicycle comprising a frame, a seat adjustably attached to said frame, a handlebar attached to said frame, said frame comprising a front fork assembly, a flywheel extending through said front fork assembly, a slave sprocket connected to said flywheel, said slave sprocket rotating about a slave sprocket axis, a pedal attached to a crank arm, a crank arm attached to a master sprocket, said master sprocket being supported by said frame and rotating about a master sprocket axis, a flexible transmitter connecting said master sprocket and said slave sprocket, an inner guard being positioned between said master sprocket and said frame, an outer guard being connected to said inner guard and a chamber being defined between said inner guard and said outer guard, a master sprocket guard and a slave sprocket guard being spaced from each other while being positioned within said chamber and being positioned between said master sprocket axis and said slave sprocket axis, said master sprocket guard overlaying a portion of the master sprocket wherein said master sprocket guard at least partially defines a first enclosed passageway and said slave sprocket guard at least partially defines a second enclosed passageway, said flexible transmitter passing through said first and second enclosed passageways.

2. The exercise bicycle of claim 1, wherein said flexible transmitter does not contact said first passageway or said second passageway.

3. The exercise bicycle of claim 1, wherein said master sprocket guard comprises an embossed portion that overlays a portion of a periphery of said master sprocket.

4. The exercise bicycle of claim 3, wherein said master sprocket guard overlays less than one-half of a circumference of said master sprocket.

5. The exercise bicycle of claim 1, wherein said master sprocket guard is secured to said inner guard with a first set of fasteners and said outer guard is secured to said inner guard separately with a second set of fasteners.

6. An exercise bicycle comprising a frame, said frame comprising a first crossing member, said first crossing member being adapted to be positioned in a fixed location on a support surface, a seat adjustably attached to said frame and a handlebar attached to said frame, a flywheel rotatably supported on said frame, a resistance assembly mounted to said frame, said resistance assembly comprising an adjustment knob, said adjustment knob adapted to allow adjustment of a level of resistance to rotation of said flywheel, a slave sprocket drivingly coupled to said flywheel, a pedal connected to a master sprocket, said master sprocket being supported by said frame, a flexible transmitter connecting said master sprocket and said slave sprocket, an inner guard connected to said frame, said inner guard comprising a body, said body being interposed between a portion of said master sprocket and said frame, said body comprising an opening, said opening being positioned in said body at a location proximate said flywheel, an outer guard being supported by said frame, said outer guard comprising a first opening and a second opening, said first opening being positioned proximate said master sprocket and said second opening having at least a portion that is generally aligned with said opening through said body of said inner guard, a master sprocket guard positioned between said inner guard and said outer guard, a slave sprocket guard positioned between said inner guard and said outer guard, at least a portion of said second opening of said outer guard being positioned between said master sprocket guard and said slave sprocket guard, and the master sprocket guard covering a meshing region between the flexible transmitter and the master sprocket when viewed from the side of the exercise bicycle wherein said master sprocket guard at least partially defines a first enclosed passageway and said slave sprocket guard at least partially defines a second enclosed passageway, said flexible transmitter passing through said first and second enclosed passageways.

7. The exercise bicycle of claim 6, wherein said flexible transmitter does not contact said first passageway or said second passageway.

8. The exercise bicycle of claim 6, wherein said master sprocket guard comprises an embossed portion that overlays a portion of a periphery of said master sprocket.

9. The exercise bicycle of claim 8, wherein said master sprocket guard overlays less than one-half of a circumference of said master sprocket.

10. The exercise bicycle of claim 6, wherein said master sprocket guard is secured to said inner guard with a first set of fasteners and said outer guard is secured to said inner guard separately with a second set of fasteners.

11. An exercise bicycle comprising a frame, a seat supported by said frame, a handlebar supported by said frame, a master sprocket supported by said frame, a slave sprocket supported by said frame, a flexible transmitter connecting said master sprocket and said slave sprocket, an outer guard being connected to said frame and overlaying said master sprocket and said slave sprocket, a master sprocket guard extending only partway around said master sprocket, said master sprocket guard being positioned between said master sprocket and said slave sprocket, said master sprocket guard at least partially defining a first enclosed passageway and a second enclosed passageway, said flexible transmitter extending through said first passageway and said second passageway.

12. The exercise bicycle of claim 11, wherein said flexible transmitter does not contact said first passageway.

13. The exercise bicycle of claim 11, wherein said master sprocket guard comprises an embossed portion that overlays a portion of a periphery of said master sprocket.

14. The exercise bicycle of claim 13, wherein said master sprocket guard overlays less than one-half of a circumference of said master sprocket.

15. An exercise bicycle comprising a frame, a seat adjustably attached to said frame, a handlebar attached to said frame, said frame comprising a front fork assembly, a flywheel extending through said front fork assembly, a slave sprocket connected to said flywheel, said slave sprocket rotating about a slave sprocket axis, a first imaginary transverse generally vertical plane extending through said slave sprocket axis, a pedal connected to a master sprocket, said master sprocket being supported by said frame and rotating about a master sprocket axis, a second imaginary transverse generally vertical plane extending through said master sprocket axis, a flexible transmitter connecting said master sprocket and said slave sprocket, a master sprocket guard and a slave sprocket guard both being connected to said frame wherein each guard is spaced from each other and not extending beyond a space bounded by said first imaginary traverse generally vertical plane and said second imaginary traverse generally vertical plane an inner guard being positioned between said master sprocket and said frame, and an outer guard being connected to said inner guard, said master sprocket guard at least partially defining a first enclosed passageway and said slave sprocket guard at least partially defining a second enclosed passageway, said flexible transmitter passing through said first and second passageways.

16. The exercise bicycle of claim 15, wherein said flexible transmitter does not contact said first passageway or said second passageway.

17. The exercise bicycle of claim 15, wherein said master sprocket guard comprises an embossed portion that overlays a portion of a periphery of said master sprocket.

18. The exercise bicycle of claim 17, wherein said master sprocket guard overlays less than one-half of a circumference of said master sprocket.

19. An exercise bicycle comprising a frame, a seat supported by said frame, a handlebar supported by said frame, a master sprocket supported by said frame, a slave sprocket supported by said frame, a flexible transmitter connecting said master sprocket and said slave sprocket, an outer guard being connected to said frame and overlaying said master sprocket and said slave sprocket, a master sprocket guard extending only partway around said master sprocket, said master sprocket guard being positioned between said master sprocket and said slave sprocket, said master sprocket guard at least partially defining an enclosed passageway, said flexible transmitter extending through said passageway and not contacting said passageway.

20. The exercise bicycle of claim 19, wherein said master sprocket guard comprises an embossed portion that overlays a portion of a periphery of said master sprocket.

21. The exercise bicycle of claim 20, wherein said master sprocket guard overlays less than one-half of a circumference of said master sprocket.

22. The exercise bicycle of claim 19, wherein said master sprocket guard is secured to said frame with a first set of fasteners and said outer guard is secured to said frame separately with a second set of fasteners.

23. An exercise bicycle comprising a frame, a seat adjustably attached to said frame, a handlebar attached to said frame, said frame comprising a front fork assembly, a flywheel extending through said front fork assembly, a slave sprocket connected to said flywheel, said slave sprocket rotating about a slave sprocket axis, a pedal attached to a crank arm, a crank arm attached to a master sprocket, said master sprocket being supported by said frame and rotating about a master sprocket axis, a flexible transmitter connecting said master sprocket and said slave sprocket, an inner guard being connected to said frame and positioned between said master sprocket and said frame, an outer guard being connected to said inner guard and a chamber being defined between said inner guard and said outer guard, a master sprocket guard and a slave sprocket guard being spaced from each other while being positioned within said chamber and being positioned between said master sprocket axis and said slave sprocket axis, said master sprocket guard at least partially defining a first enclosed passageway and said slave sprocket guard at least partially defining a second enclosed passageway, and said flexible transmitter passing through said first and second enclosed passageways.

24. The exercise bicycle of claim 23, wherein said flexible transmitter does not contact said first passageway or said second passageway.

25. An exercise bicycle comprising a frame, said frame comprising a first crossing member, said first crossing member being adapted to be positioned in a fixed location on a support surface, a seat adjustably attached to said frame and a handlebar attached to said frame, a flywheel rotatably supported on said frame, a resistance assembly mounted to said frame, said resistance assembly comprising an adjustment knob, said adjustment knob adapted to allow adjustment of a level of resistance to rotation of said flywheel, a slave sprocket drivingly coupled to said flywheel, a pedal connected to a master sprocket, said master sprocket being supported by said frame, a flexible transmitter connecting said master sprocket and said slave sprocket, an inner guard connected to said frame, said inner guard comprising a body, said body being interposed between a portion of said master sprocket and said frame, said body comprising an opening, said opening being positioned in said body at a location proximate said flywheel, an outer guard being supported by said frame, said outer guard comprising a first opening and a second opening, said first opening being positioned proximate said master sprocket and said second opening having at least a portion that is generally aligned with said opening through said body of said inner guard, a master sprocket guard positioned between said inner guard and said outer guard, a slave sprocket guard positioned between said inner guard and said outer guard, at least a portion of said second opening of said outer guard being positioned between said master sprocket guard and said slave sprocket guard, said master sprocket guard at least partially defining an enclosed first passageway and said slave sprocket guard at least partially defining an enclosed second passageway, said flexible transmitter passing through said first and second enclosed passageways.

26. The exercise bicycle of claim 25, wherein said flexible transmitter does not contact said first passageway or said second passageway.

27. An exercise bicycle comprising a frame, said frame comprising a first crossing member, said first crossing member being adapted to be positioned in a fixed location on a support surface, a seat adjustably attached to said frame and a handlebar attached to said frame, a flywheel rotatably supported on said frame, a resistance assembly mounted to said frame, said resistance assembly comprising an adjustment knob, said adjustment knob adapted to allow adjustment of a level of resistance to rotation of said flywheel, a slave sprocket drivingly coupled to said flywheel, a pedal connected to a master sprocket, said master sprocket being supported by said frame, a flexible transmitter connecting said master sprocket and said slave sprocket, an inner guard connected to said frame, said inner guard comprising a body, said body being interposed between a portion of said master sprocket and said frame, said body comprising an opening, said opening being positioned in said body at a location proximate said flywheel, an outer guard being supported by said frame, said outer guard comprising a first opening and a second opening, said first opening being positioned proximate said master sprocket and said second opening having at least a portion that is generally aligned with said opening through said body of said inner guard, a master sprocket guard positioned between said inner guard and said outer guard, a slave sprocket guard positioned between said inner guard and said outer guard, at least a portion of said second opening of said outer guard being positioned between said master sprocket guard and said slave sprocket guard, said master sprocket guard comprising an embossed portion that overlays a portion of a periphery of said master sprocket wherein said master sprocket guard at least partially defines a first enclosed passageway and said slave sprocket guard at least partially defines a second enclosed passageway, said flexible transmitter passing through said first and second enclosed passageways.

28. The exercise bicycle of claim 26, wherein said master sprocket guard overlays less than one-half of a circumference of said master sprocket.

* * * * *